US006941885B2

(12) United States Patent
Zimmerman et al.

(10) Patent No.: US 6,941,885 B2
(45) Date of Patent: Sep. 13, 2005

(54) ANCHOR FOR MARINE MOORING

(76) Inventors: Evan H. Zimmerman, 11719 Pecan Creek Dr., Houston, TX (US) 77043; Matthew W. Smith, 1511 Warwickshire Dr., Houston, TX (US) 77077; Alan G. Young, 2619 Hodges Bend Cir., Sugarland, TX (US) 77479-1406

( * ) Notice: Subject to any disclaimer, the term of this patent is extended or adjusted under 35 U.S.C. 154(b) by 0 days.

(21) Appl. No.: 10/977,959

(22) Filed: Oct. 29, 2004

(65) Prior Publication Data

US 2005/0120936 A1 Jun. 9, 2005

Related U.S. Application Data

(60) Provisional application No. 60/515,744, filed on Oct. 30, 2003.

(51) Int. Cl.[7] ..... B63B 21/24
(52) U.S. Cl. ..... 114/294; 52/155
(58) Field of Search ..... 114/293, 294, 295, 114/301; 52/155, 156, 162–164

(56) References Cited

U.S. PATENT DOCUMENTS 631,168 A * 8/1899 Langston ..... 52/155
3,611,974 A * 10/1971 Joppa et al. ..... 114/294
3,850,128 A * 11/1974 Lovell ..... 114/295
3,946,695 A * 3/1976 Isaak ..... 114/293
4,738,063 A * 4/1988 Alsop ..... 52/163

* cited by examiner

*Primary Examiner*—Ed Swinehart
(74) *Attorney, Agent, or Firm*—Jesse D. Lambert

(57) ABSTRACT

Anchor for mooring of buoyant marine structures. The anchor comprises an elongated shaft with a mooring line attachment that is rotatable around the full circumference (that is, a full 360 degrees of rotation) of the anchor shaft. The lower end of the shaft comprises nose section, while the upper end comprises a tail section. A plurality of fins are attached to the nose section and tail section, and extend radially outward from the anchor shaft. While the number of fins may vary, one presently preferred embodiment has three fins in each section of the anchor shaft. The anchor is preferably configured (via design of the nose and tail section fin areas, shapes, etc., and the location of the mooring line attachment along the anchor shaft) such that less soil resistance is created on the nose section than on the tail section under the influence of a mooring line load, so that the anchor will rotate slightly about the mooring line attachment point under the applied load while penetrating deeper into the soil underlying the seabed.

19 Claims, 6 Drawing Sheets

ANCHOR FOR MARINE MOORING

CROSS REFERENCES TO RELATED APPLICATIONS

This application claims priority for all purposes to provisional patent application Ser. No. 60/515,744, filed Oct. 30, 2003.

BACKGROUND

1. Field of Invention

This invention relates to apparatus and method for mooring of marine structures. With more particularity, this invention relates to an anchor especially (although not exclusively) suitable for gravity installation, which embeds itself in a seabed by virtue of being dropped from a height above the seabed and being allowed to fall to the seabed of its own weight, and methods of installation of such anchor.

2. Description of Prior Art

A large suite of different anchor designs have evolved over the decades that rely on the anchor to embed or to be drug into the seabed to develop the holding capacity for the required mooring line load. These anchor designs vary widely in form or shape, from a caisson or pile to a conventional drag embedment anchor that includes flukes that open as the anchor is drug into location. These anchors have major disadvantages in that they are difficult to embed to deep penetrations below the seabed, where the underlying soils are stronger and thus can provide greater holding capacity.

Other anchor designs have been developed such as gravity installed anchors that are installed by freefalling under the force of gravity. These anchors are lowered down through the water column to a desired height above the seabed, and then released, whereby their own weight carries the anchor to and into the seabed under the influence of gravity. Examples of existing known example gravity installed anchors of this type include U.S. Pat. No. 6,106,199 to Medeiro, Jr. et al (Aug. 22, 2000) and U.S. Pat. No. 6,257,166 to Lieng (Jul. 10, 2001). The known prior art anchors are less effective that the present invention for several reasons. One disadvantage with the existing designs is that the behavior of the anchor under increasing loading does not allow the anchor to dig deeper into the stronger soils typically encountered at greater penetrations. The geometry and mooring line attachment point of the anchor of the present invention are designed such that the anchor will dig into the deeper soil under higher line loading. Another disadvantage of the prior art anchors involves limits placed on the mooring line direction (that is, loads in a direction radially outward from the anchor shaft) unless the attachment line is placed at the top of these anchors; such top placement severely limits the anchor's holding capacity. When using a side attachment of the mooring line on the prior art anchors, the mooring line angle is limited to a small variation from the fixed radial direction of the attachment point, so proper orientation of the anchor is critical to achieve an appropriate mooring spread. Such orientation (that is, orienting the attachment point in a desired radial direction) may be very difficult to accurately achieve. In contrast, the anchor of the present invention features a rotating mooring line attachment point on the shaft of the anchor, which is free to rotate to any direction around the longitudinal axis of the anchor shaft under influence of the mooring line force, thereby permitting the anchor to achieve optimum holding capacity while eliminating rotational orientation concerns during installation.

DETAILED DESCRIPTION OF THE PRESENTLY PREFERRED EMBODIMENTS

Several of the primary structural attributes of the anchor of the present invention are first generally described. Such attributes can be modified and configured to suit particular applications.

1. Anchor shaft. The shaft may be designed with a larger outer diameter over the lower section (proximal to the nose section of the anchor) to both add mass, lower the center of gravity and reduce relative frictional resistance on the upper section while the anchor is penetrating the soil. In one embodiment of the anchor, the anchor shaft terminates in a pointed cone in the nose section (i.e. the lower end), and the nose section fins do not extend beyond the base of the cone, greater soil penetration can generally be achieved due to reduced frictional soil forces developing on the point.

2. Radial fins. Similar to the holding attributes of a plate type anchor, the radial fins of the present anchor provide a majority of the soil resistance needed for the anchor holding capacity. The profile shape and size of the fins can be modified depending upon soil types, expected loading, etc. In addition, the shape of the leading edge of the fins (especially but not exclusively the nose section fins) can be formed to be most favorable (with regard to ease of penetration) for the soil conditions at the site of each application. For example, the leading edge of the nose section fins can be thicker than the thickness of the remainder of the fin, to reduce the overall frictional forces on the fin.

3. Rotating mooring line attachment. The mooring line attachment provides an attachment point which can rotate to any direction, radially, from the longitudinal axis of the anchor shaft, while being constrained as to movement along the longitude or length of the anchor shaft by one or more shoulder surfaces on the shaft. The rotating mooring line attachment connector can be of various embodiments. One embodiment comprises a tapered grove which accepts a standard shackle type connection; the shoulders of the groove constrain movement of the shackle along the shaft. Another embodiment comprises a grooved shaft and a load ring type connection. The load ring connection may be achieved by two fabricated sections that are affixed together about and within the grooved section of the anchor shaft. The load ring may comprise a fabricated padeye or clevis for connection to a mooring line. A bushing or bearing surface may be utilized to allow efficient rotation of the attachment point under selected loads. Other shoulder surface arrangements are possible, such as shoulders or lugs which protrude from the otherwise relatively uniform outer diameter of the shaft.

Figure 1:
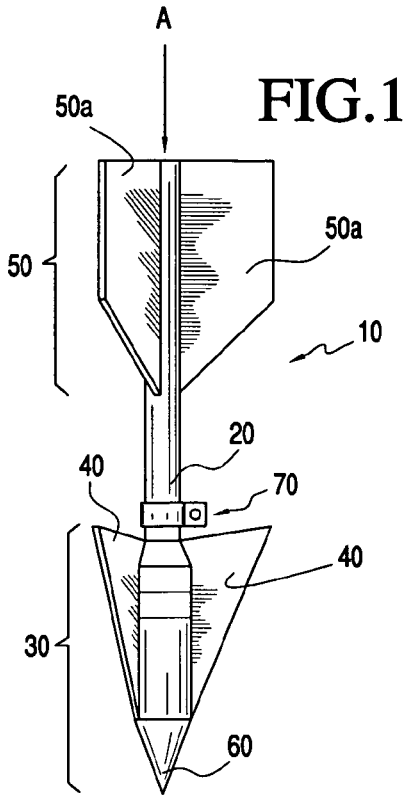
FIGS. 1 and 2 are side and perspective views of one embodiment of the anchor.
Figure 2:
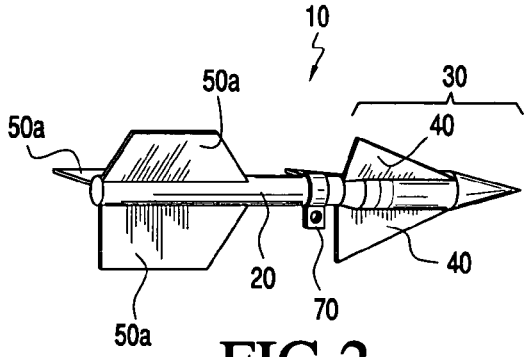
Figure 3:
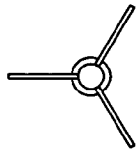
FIG. 3 is a view of the anchor of FIG. 1, in the direction of arrow A.

In more detail, and with reference to the appended drawings, some of the presently preferred embodiments of the present invention will now be described. Referring first to FIGS. 1–3, which show one possible embodiment of the anchor of the present invention, anchor 10 comprises a shaft 20. Shaft 20, depending upon a particular application, may be a solid member or a hollow tubular member or pipe, typically (although not exclusively) made from a high strength metal. Nose section 30, at the bottom end of anchor 10 (when in its usual orientation, when penetrating into a seabed) in a presently preferred embodiment comprises three or more radial fins 40 shaped to minimize hydrodynamic drag in the water column and to maximize soil penetration below the seabed. While the drawings show three radial fins 40, it is understood that various embodiments may comprise fewer (i.e. two fins) or more than three (i.e. four or more). A tail section 50 also comprises a plurality of radial fins 50*a* that serve as stabilizing fins and also provide soil reaction. As with the nose section 30, tail section 50 may comprise different numbers of fins 50*a*, depending upon the particular application. Fins 40 and 50*a* are generally arranged at equal spacing around the circumference of shaft 20; for example, FIG. 3 shows the typical arrangement of fins, viewed in the direction of A in FIG. 1.

Figure 4:
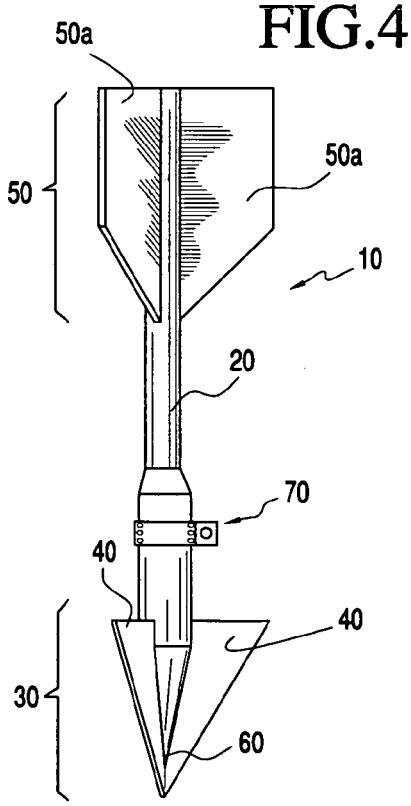
FIGS. 4 and 5 are side and perspective views of another embodiment of the anchor.
Figure 5:
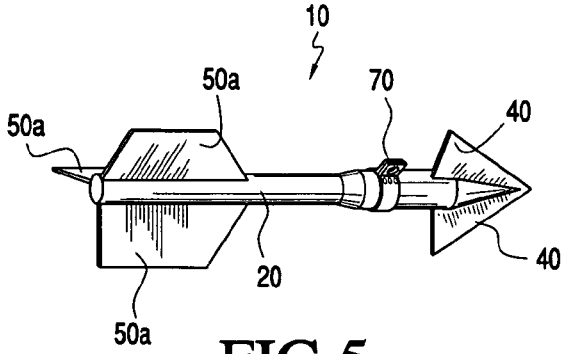

FIGS. 4 and 5 show another embodiment of anchor 10, differing from that shown in FIGS. 1 and 2 chiefly by the placement of fins 40 in nose section 30. Referring to both FIGS. 1 and 4, it can be seen that the end of shaft 20 in nose section 30 terminates in a pointed cone shape, 60. In the embodiment shown in FIGS. 1 and 2, fins 40 terminate at or near the base of cone 60, i.e. cone 60 is the leading penetrating surface. In the embodiment shown in FIGS. 4 and 5, fins 40 extend past the nose of cone 60, so that fins 40 comprise the leading penetrating surface. Different applications, including soil type, etc., influence which embodiment may be best suited; in general, the embodiment of FIGS. 1 and 2 yields increased seabed penetration.

Figure 8:
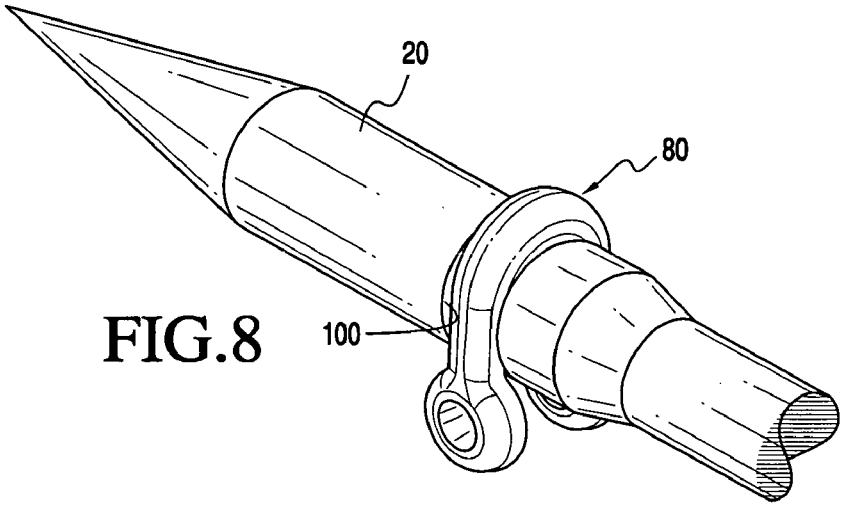
FIGS. 8 and 9 show two possible embodiments of the rotating mooring line attachment.
Figure 9:
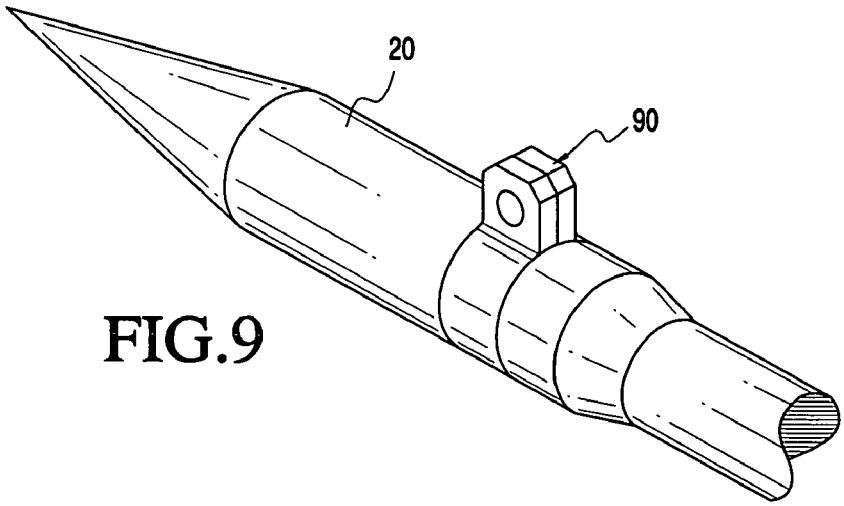
Figure 9A:
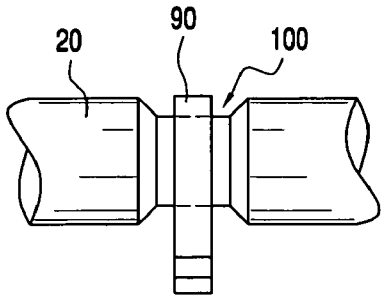
FIGS. 9A and 9B show different possible arrangements of ring assembly 90 on shaft 20.
Figure 9B:
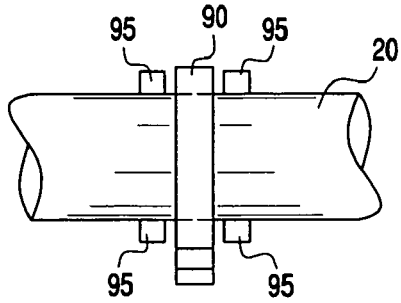
Figure 10A:
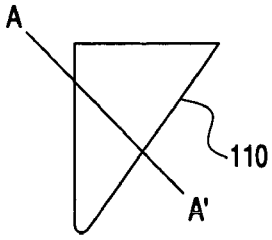
FIGS. 10A to 10C show different fin profile shapes.
Figure 10B:
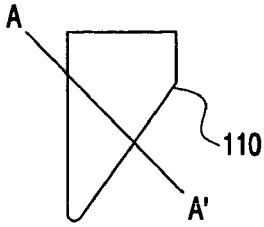
Figure 10C:
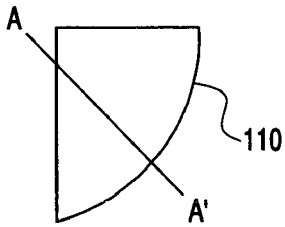
Figure 12:
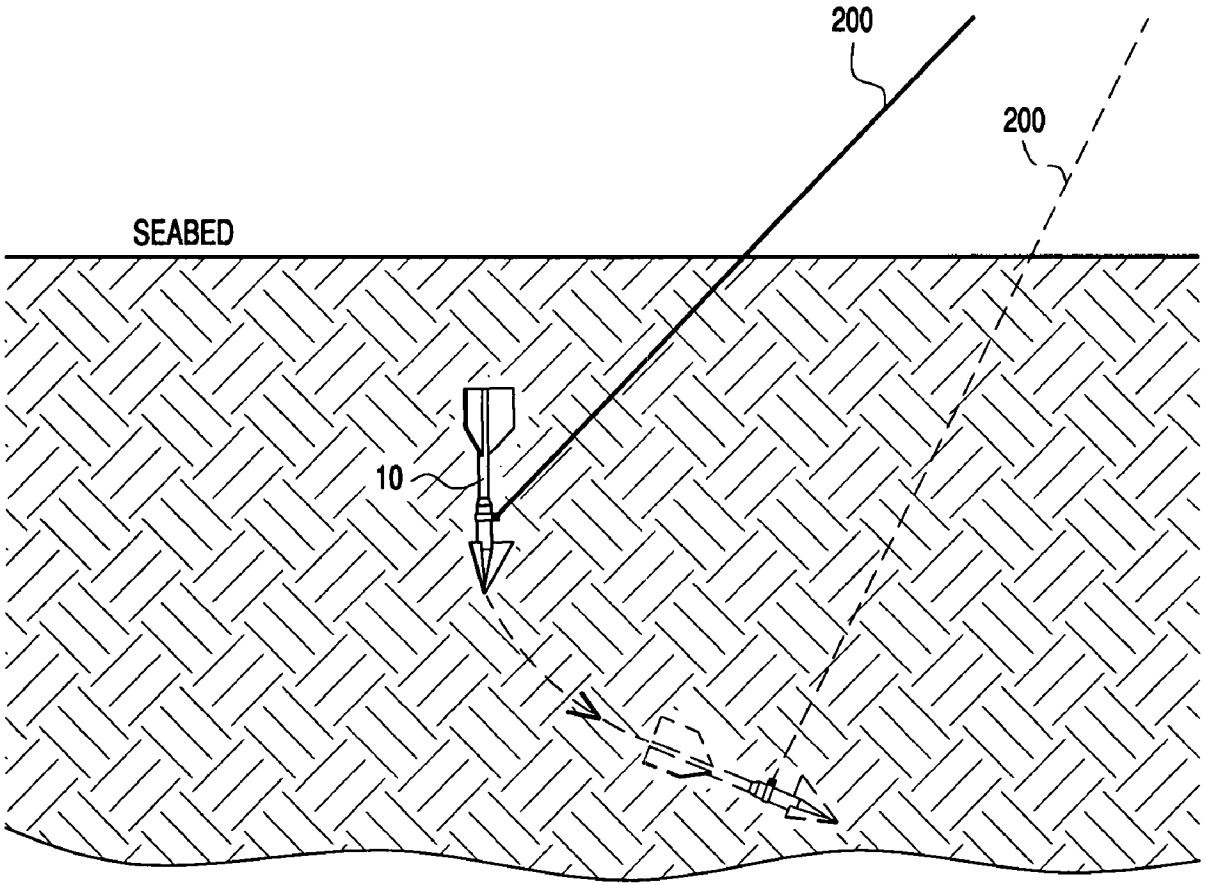
FIG. 12 shows an anchor of the present invention after penetration into a seabed, before and after a mooring line load is applied.

Mooring line attachment 70, as seen in FIGS. 1, 2, 4 and 5, and in greater detail in FIGS. 8 and 9, allows the mooring line 200 (as seen in FIG. 12) to rotate to any radial position (in a full 360 degree arc) about the anchor shaft 20. FIGS. 8 and 9 show two different embodiments of the mooring line attachment. In FIG. 8, a conventional shackle 80 is placed around a groove 100 in shaft 20, with the eyes of the shackle positioned so that a pin can be inserted through them in the conventional manner for attachment of a mooring line. The diameter of the shackle is such that it can rotate freely completely around the anchor shaft, yet cannot move any appreciable distance up or down the anchor shaft (i.e. is confined to the groove by the shoulders of the groove). FIG. 9 is a similar mooring line attachment, but which uses a ring assembly 90 in lieu of the shackle of FIG. 8. In one embodiment, the ring assembly comprises two substantially half circle pieces, which are brought together around the anchor shaft and generally within a groove in the shaft, and which are then joined (for example, by bolting together). Depending upon the size of the anchor and mooring line attachment, in other embodiments the ring assembly may be fabricated first, and the anchor shaft essentially built within the ring assembly. It is understood that instead of a groove in shaft 20, shackle 80 or ring assembly 90 could be confined along the length of shaft 20 by one or more lugs or shoulders, protruding above the surrounding shaft surface. FIG. 9A shows different possible arrangements of either the shackle or ring assembly 90 (illustrated) on shaft 20, constrained by grooves, lugs 95, full circumference shoulders, etc. These are offered by way of example only of the various possible configurations. It is to be understood that the present anchor may have one or more than one mooring line attachment thereon (for example, two mooring line attachments if two structures are to be moored to a single anchor).

The position of the mooring line attachment along the longitude of shaft 20 also provides a design feature allowing for the total distribution of soil resistance developed on the radial fins of the nose and tail sections about the attachment point to develop deeper embedment and slight rotation as the mooring line loading increases. The benefit of this feature is that the anchor holding capacity increases with deeper embedment and a more optimum orientation with the applied angle of the mooring line. Reference is made to FIG. 12 which illustrates first and second positions of anchor 10, in response to a load applied to mooring line 200. It is desired that anchor 10 penetrate deeper into the soil, under the influence of a load applied to mooring line 200. Increased holding capacity results, as the deeper sediments are typically stronger (in the sense that they are denser and more resistant to movement therethrough) and the anchor assumes an optimized orientation with respect to the angle of the mooring line. In particular, with applied load, the anchor shaft moves to a position substantially perpendicular to the direction of the mooring line. The anchor movement and orientation shown in FIG. 12 is achieved by designing the location of the mooring line attachment along the length of the anchor shaft, and the various design attributes of the radial fins (for example, the number of fins, their area and profile shape), such that the anchor rotates from a position which is initially substantially vertical (as shown in FIG. 12) to a position nearly perpendicular to mooring line 200. This behavior is produced by designing the various attributes of the anchor so that when a load is applied to the mooring line, a lesser force moment is created by the action of the soil on the nose section, than on the tail section; therefore, the nose will tend to rotate toward the mooring line until these moments reach equilibrium; then with increased load, the anchor dives deeper into the soil.

Referring particularly to FIGS. 10A–10C and 11A–11C: the radial fins 40 (of the arrow point) and 50*a* (of the tail section) can have certain attributes which enhance performance of anchor 10, and which permit modifications to the anchor to especially suit it for particular applications. First, the profile shape of the fins can also be altered to suit particular applications. FIG. 10 shows two profiles in which a straight line forms most of the profile shape. In the rightmost embodiment in FIG. 10, the profile is a portion of an ellipse. It is understood that different combinations of profile shapes can be used (for example, portions of circles, etc.), depending upon soil types, etc.

Figure 11A:
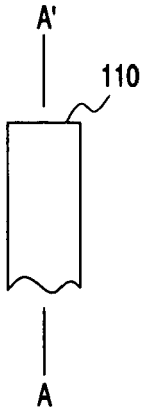
FIGS. 11A–11C show different shapes of the leading edges of the fins.
Figure 11B:
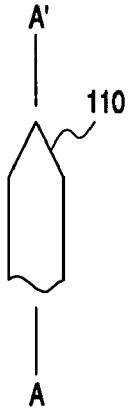
Figure 11C:
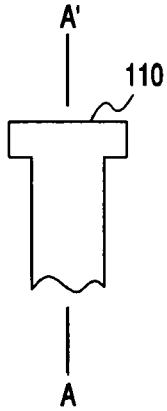

Second, the leading edge 110 of the fins may have different cross-section shapes. Lines A–A' in FIGS. 10A–10C indicate lines of section across the fins; FIGS. 11A–11C show leading edge shapes along those section lines. FIG. 11A shows a fin in which leading edge 110 is simply cut more-or-less square across. FIG. 11B shows a "knife edge," in which leading edge 110 is brought to a V-shape. FIG. 11C shows a fin in which leading edge has a larger width than the main body of the fin. Such a shape can enhance penetration in certain soils. Other leading edge shapes are possible, depending upon particular applications.

Figure 6:
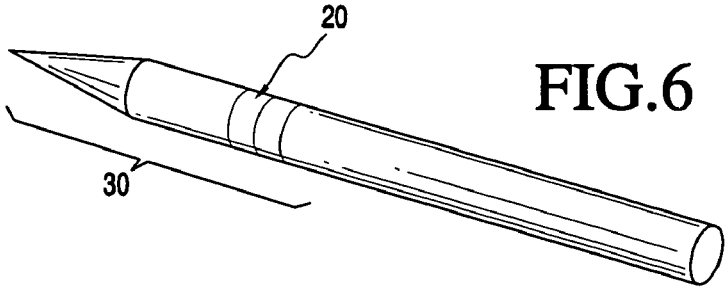
FIGS. 6 and 7 show further detail of the anchor shaft.
Figure 7:
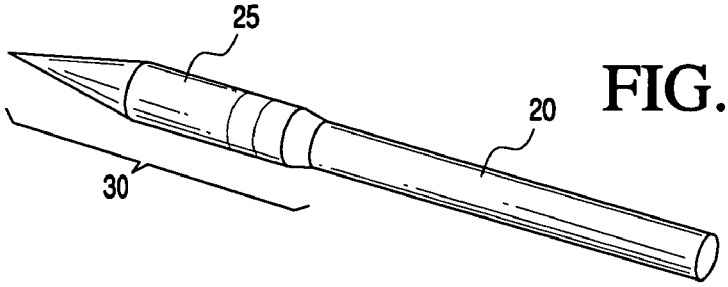

FIGS. 6 and 7 show more detail on the shape of shaft 20 of anchor 10 (for clarity, fins 40 are omitted from these figures). FIG. 6 shows a shaft which is substantially of equal outer diameter over its length. FIG. 7 shows a shaft having a larger outer diameter section proximal to the nose section 30 (lower point end) of shaft 20. Such larger diameter can result in a shifting of the center of gravity closer to nose section 30 (that is, the anchor will be bottom heavy), and can result in a decreased friction force for the upper end of the shaft.

With regard to materials for the anchor, generally different types of metals would likely be used. Shaft 20 can be a hollow, tubular member, if desired at least partially filled with a weighting material to give a desired weight distribution; or can be solid. Fins 40 and 50*a* may be formed from or cut out of plate metals of different types. The fins can be fastened to shaft 20 by welding or other means well known in the relevant art. It is understood, however, that some or all of the anchor could be of non-metal materials. For example, in one embodiment, shaft 20 is metal, while fins 40 and 50*a* are structural fiberglass or other non-metal composite material, fixed to shaft 20 by adhesives, bolting, or other means known in the art.

Dimensions of the anchor and its various components can be varied to suit particular applications. For illustrative purposes only, for typical MODU (mobile offshore drilling unit) installations, the anchor may weigh on the order of 60,000 lbs.; have an overall length of approximately 30 feet; and a "wingspan" (diameter across the fins) of approximately 9 feet.

Installation of the Anchor

The anchor of the present invention may be installed in a similar fashion as other anchors by allowing it to drop and free-fall through the water column under the force of gravity. Anchor 10 may also be installed by other methods such as vibration, dead weight, hammers, or suction embedment.

Figure 13C:
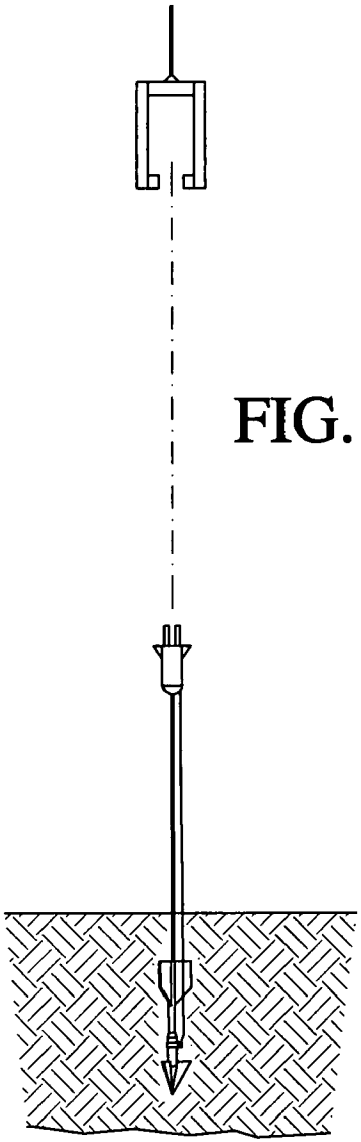
FIGS. 13A–13C and 14 show two different anchor installation methods.
Figure 13B:
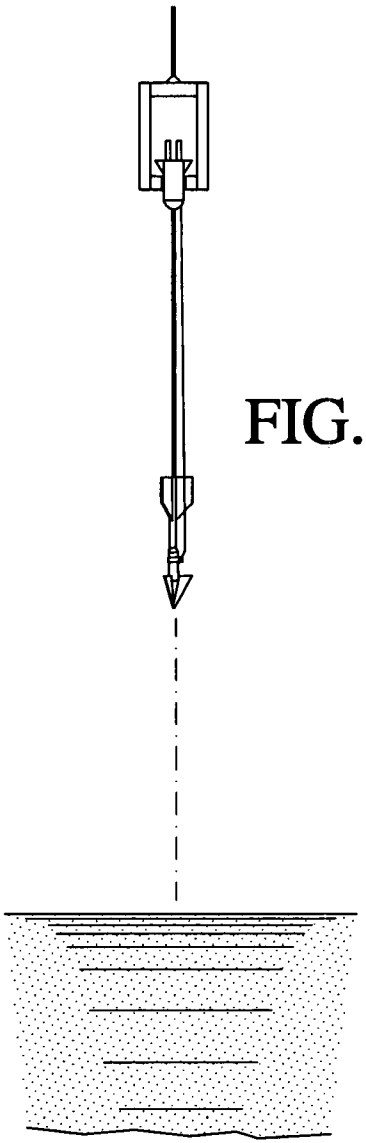
Figure 13A:
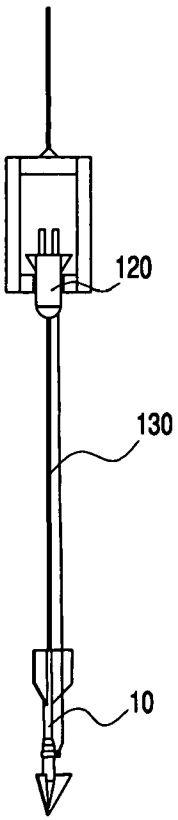
Figure 14:
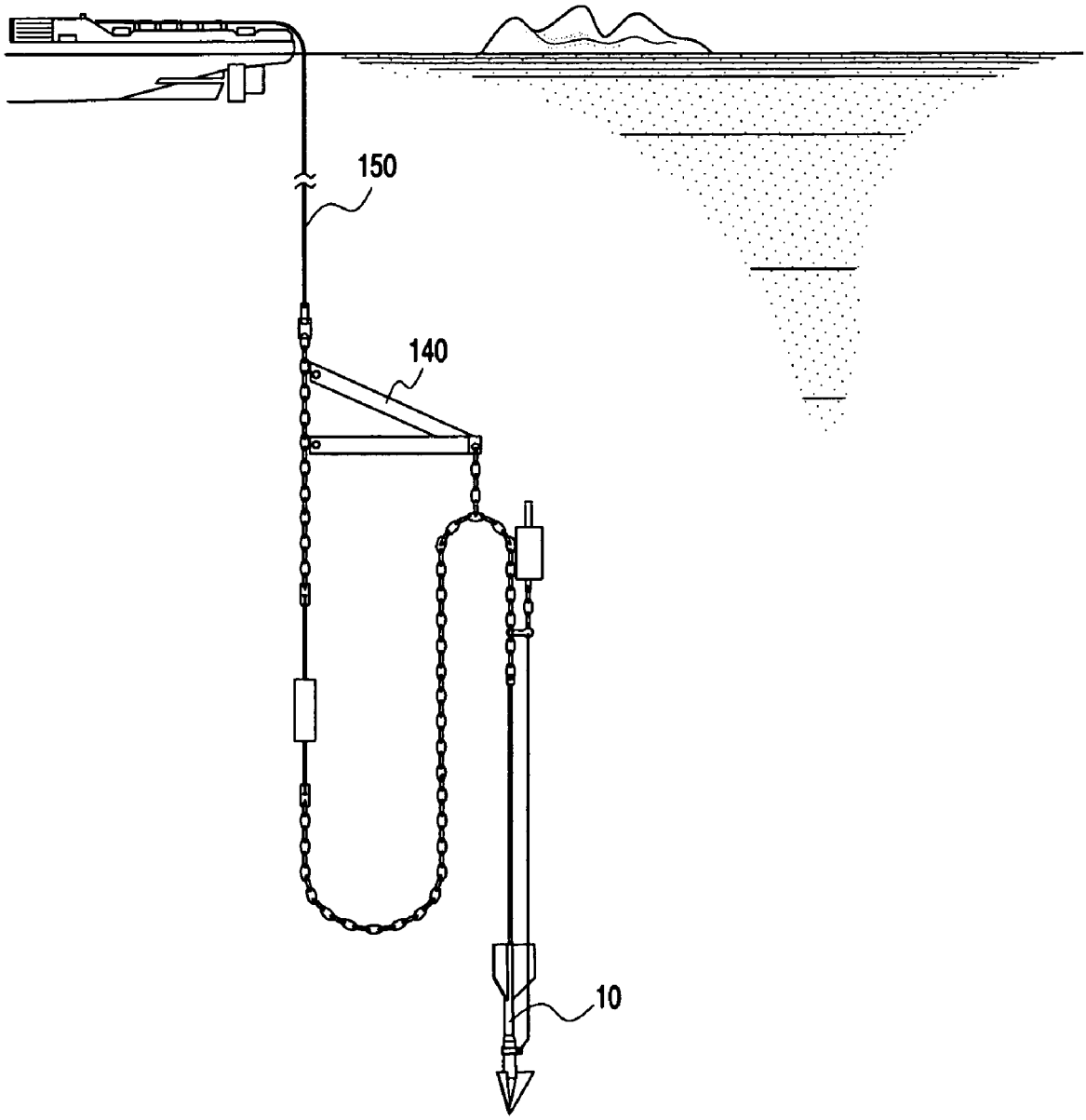

Installation of anchor 10 can be performed off any type of marine vessel that is equipped with a deployment line (cable, rope, or chain) and a powered winch capable of lowering the anchor to a predetermined height above the seabed. At this point the anchor is released allowing it to freefall. With a freefall installation, as can be seen in FIGS. 13A–13C, a trailing buoy 120 can be fastened to anchor 10 (via line 130) to assist in keeping anchor 10 in a vertical position during freefall and embedment into the seabed. In addition to or in lieu of a buoyant buoy, one or both of the lines attached to the anchor can be a rigid member (for example, a metal rod), or can be a flexible member running through a rigid member, such as a pipe. While installation particulars will vary depending upon the particular application at hand, for exemplary purposes the anchor may be released approximately 200 feet above the seabed, and will penetrate to a depth of about 80 feet (distance of the arrow point below the seabed). FIG. 14 shows another installation method, using a release frame 140 lowered on line 150. It is to be noted that the anchor assemblies shown in FIGS. 13A–13C and 14 show both a mooring line (generally attached to a point along the length of the anchor) and a recovery line (generally attached centrally on the uppermost end of the anchor, when in position in a seabed). It is to be understood that the present anchor may have one or more mooring lines thereon, for example in the event that more than one structure is to be moored to the anchor.

While the preceding description contains much specificity, it is understood that same are offered in order to illustrate some of the presently preferred embodiments of the invention, and not by way of limitation. Many changes could be made to the invention, and would be recognized by those having ordinary skill in the art, while not departing from the spirit of the invention. For example, dimensions and weights of the anchor can be altered to suit particular applications; different materials could be used for various parts of the anchor, in that metals can be used for some parts, while other parts (for example, the fins) can be made from non-metals such as structural fiberglass; the profile shape of the fins can be altered; the leading edges of the fins can be changed to suit particular applications; the anchor shaft can be solid or hollow, and can be of a uniform outer diameter or can have a non-uniform outer diameter; and the rotating mooring line attachment can be of different embodiments.

Therefore, the scope of the invention is not confined to the examples given, but is limited only by the scope of the appended claims and their legal equivalents.

We claim:

1. A seabed penetrating anchor, comprising:

a) a central elongated shaft having a tail section proximal one end and a nose section proximal another end;

b) a plurality of radially outwardly extending fins disposed on said shaft in said tail section;

c) a plurality of radially outwardly extending fins disposed on said shaft in said nose section; and d) a rotatable mooring line attachment disposed on said shaft between said tail section and said nose section, wherein said mooring line attachment is rotatable to any point around a circumference of said shaft under the influence of a mooring line force.

2. The anchor of claim 1, wherein said tail section comprises three fins.

3. The anchor of claim 2, wherein said nose section comprises three fins.

4. The anchor of claim 3, wherein said rotatable mooring line attachment comprises a collar member at least partially encircling said shaft and longitudinally fixed on said shaft by one or more shoulders on said shaft.

5. The anchor of claim 4, wherein said collar member is disposed in a groove on said shaft.

6. The anchor of claim 4, wherein said collar member comprises a shackle.

7. The anchor of claim 4, wherein said collar member comprises a load ring.

8. The anchor of claim 1, wherein at least some of said fins have a profile shape comprising a straight edge angled away from a longitude of said shaft.

9. The anchor of claim 1, wherein at least some of said fins have a profile shape comprising a portion of an ellipse.

10. The anchor of claim 1, wherein the outer edges of said fins comprise a rectangular edge.

11. The anchor of claim 1, wherein the outer edges of said fins comprise a V-shaped edge.

12. The anchor of claim 1, wherein the outer edges of said fins comprise a width larger than a thickness of said fins.

13. The anchor of claim 1, wherein the end of said shaft comprising said nose section forms a pointed cone, and wherein said fins in said nose section terminate before a base of said cone.

14. The anchor of claim 1, wherein said fins in said nose section extend beyond the end of said shaft comprising said nose section.

15. The anchor of claim 1, wherein said shaft is hollow.

16. The anchor of claim 1, wherein said shaft is solid.

17. The anchor of claim 1, wherein an outer diameter of said shaft proximal said nose section is larger than an outer diameter of the remainder of said shaft.

18. The anchor of claim 1, wherein said mooring line attachment is longitudinally fixed on said shaft at a location which, when said anchor is subjected to a horizontal force from said mooring line when said anchor is embedded in soil, creates a force tending to rotate said nose section toward said mooring line.

19. The anchor of claim 1, further comprising a trailing buoy connected to said anchor by a line, whereby when said anchor is installed by a freefall method said trailing buoy tends to maintain said anchor in a vertical orientation.

* * * * *